US011401104B2

(12) United States Patent
Laidler et al.

(10) Patent No.: US 11,401,104 B2
(45) Date of Patent: Aug. 2, 2022

(54) ADAPTER AND DISPENSER WITH ADAPTER

(71) Applicant: Plastipak BAWT S.á.r.l., Bascharage (LU)

(72) Inventors: Keith Laidler, West Midlands (GB); Timothy Rodd, Hampshire (GB)

(73) Assignee: Plastipak BAWT, S.à.r.l., Bascharage (LU)

( * ) Notice: Subject to any disclaimer, the term of this patent is extended or adjusted under 35 U.S.C. 154(b) by 0 days.

(21) Appl. No.: 16/675,567

(22) Filed: Nov. 6, 2019

(65) Prior Publication Data

US 2020/0140184 A1 May 7, 2020

Related U.S. Application Data

(60) Provisional application No. 62/756,159, filed on Nov. 6, 2018.

(51) Int. Cl.
*B65D 83/32* (2006.01)

(52) U.S. Cl.
CPC ..... *B65D 83/32* (2013.01)

(58) Field of Classification Search
CPC ..... B65D 83/32
USPC ..... 222/464.2
See application file for complete search history.

(56) References Cited

U.S. PATENT DOCUMENTS 3,044,650 A * 7/1962 Oltion ..... A61J 9/00 215/11.1
3,580,430 A * 5/1971 Angele ..... B65D 83/32 222/394
4,148,419 A * 4/1979 MacNair ..... B65D 83/425 141/20
5,195,664 A * 3/1993 Rhea ..... B05B 11/0059 222/464.4
7,240,810 B2 * 7/2007 Harrity ..... B05B 11/0059 222/464.4
7,690,536 B2 4/2010 Briozzo Fernandez
8,961,050 B2 2/2015 Chesson
2004/0089674 A1 5/2004 Harrity et al.
2006/0138171 A1 * 6/2006 Briozzo Fernandez ..... B05B 7/0037 222/190
2011/0092868 A1 * 4/2011 Chesson ..... A61M 35/006 602/41

(Continued)

FOREIGN PATENT DOCUMENTS

AT 307305 B 5/1973
GB 1184065 A 3/1970
GB 2356674 A 5/2001

OTHER PUBLICATIONS

International Search Report, PCT/IB2019/059554, dated Feb. 7, 2020.
Machine Translation AT 307305B (Google Patents).

*Primary Examiner* — Vishal Pancholi
(74) *Attorney, Agent, or Firm* — Fishman Stewart PLLC

(57) ABSTRACT

An adapter for a dispenser includes a longitudinal body with a first end that may be configured for connection with a dip tube and a second end that may be configured for connection with another object, such as a foam component. In embodiments, a cross piece is disposed between the first end and the second end. Further, in embodiments, one or more structures, such as barbs, may be provided between a cross piece and the second end.

20 Claims, 4 Drawing Sheets

(56) References Cited

U.S. PATENT DOCUMENTS

2015/0001317 A1* 1/2015 Wei ..... B05B 11/0059
239/375

* cited by examiner

ADAPTER AND DISPENSER WITH ADAPTER

CROSS-REFERENCE TO RELATED APPLICATION

This application claims the benefit of priority to U.S. Provisional Application No. 62/756,159, filed Nov. 6, 2018, the entire disclosure of which is incorporated herein by reference.

TECHNICAL FIELD

The present disclosure generally relates to dispensers and dispensers with dip tubes and/or adapters, including dispensers that have an adapter and are suitable for aerosol applications.

BACKGROUND

Dispensers, such as pressurized dispensers or containers for aerosol applications, may include a body or shell, a valve, and a dip tube that may extend from the valve to the product or contents within the body or shell.

Moreover, some dispensers include a foam component. For example and without limitation, some dispensers include a foamed or cellular material. The disclosure of U.S. Pat. No. 10,077,150 is incorporated herein by reference in its entirety.

Common nozzle arrangements may include an inlet, an outlet through which a fluid may be dispensed to an external environment, and an internal flow passageway through which fluid can flow from the inlet to the outlet. Nozzle arrangements may additionally include an actuator—such as a manually operated pump or trigger or aerosol canister. Operation of the actuator can cause fluid to flow into the inlet of the arrangement, along the flow passageway, and on to the outlet. A number of manually operated aerosol cans, pumps, or triggers may have a dip tube, which may extend, for example, from a top or outlet of a container to the bottom of the container, so as to draw fluid from the bottom to the top. Some dip tubes may be part of a container and may be centered or along a wall of a container.

With some dispensers it can be a challenge to hold a foam component on a dip tube in a set or desired position, particularly when a dispenser is going through an automated filling lines from feeder bowls, where they can be thrown around. Pushing the foam component into position or place is commonly not an option, and welding can be tricky as well as expensive.

As such, there is a desire for solutions and/or options that, among other things, can address some of the challenges associated with dispensers and dispenser dip tubes. The foregoing discussion is intended only to illustrate examples of the present field and should not be taken as a disavowal of scope.

SUMMARY

An adapter for a dispenser includes a longitudinal body with a first end that may be configured for connection with a dip tube and a second end that may be configured for connection with another object, such as a foam component. In embodiments, a cross piece is disposed between the first end and the second end. Further, in embodiments, one or more structures, such as barbs, may be provided between a cross piece and the second end.

The foregoing and other aspects, features, details, utilities, and/or advantages of embodiments of the present disclosure will be apparent from reading the following description, and from reviewing the accompanying drawings.

DETAILED DESCRIPTION

Reference will now be made in detail to embodiments of the present disclosure, examples of which are described herein and illustrated in the accompanying drawings. While the present disclosure will be described in conjunction with embodiments and/or examples, it will be understood that they are not intended to limit the present disclosure to these embodiments and/or examples. On the contrary, the present disclosure is intended to cover alternatives, modifications, and equivalents.

Figure 1:
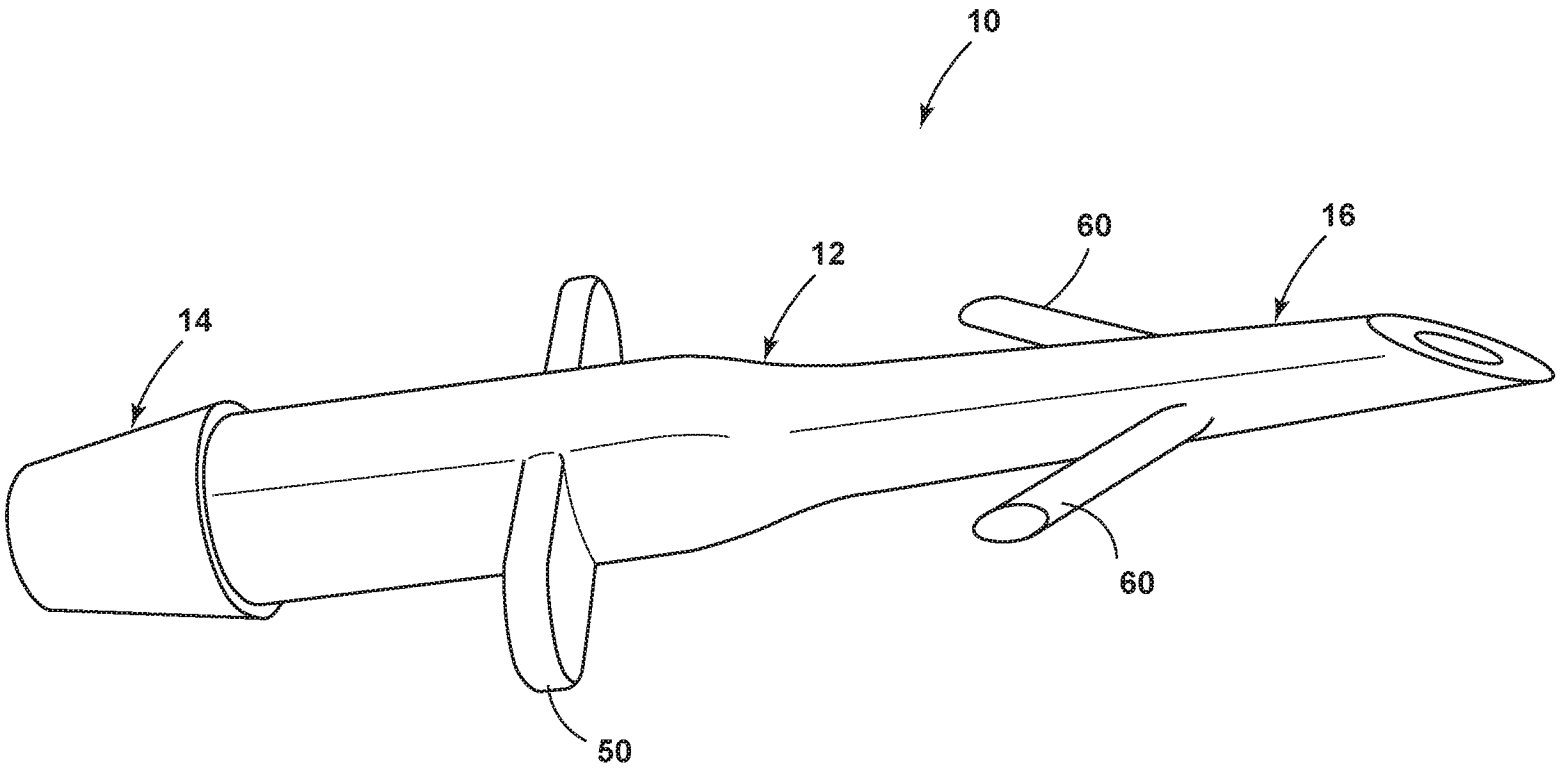
FIG. 1 is perspective view generally illustrating an embodiment of an adapter according to aspects and/or teachings of the present disclosure.
Figure 5:
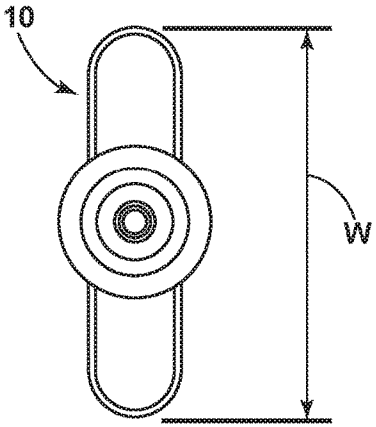
FIG. 5 is a top view of an embodiment of an adapter such as generally illustrated in FIGS. 3 and 4.

FIG. 1 generally illustrates an embodiment of an adapter 10 according to aspects and/or teachings of the present disclosure. An adapter may include a longitudinal body 12 with a first end 14 that may be configured for connection with a dip tube and a second end 16 that may be configured for connection with another object, such as a foam component. In embodiments, the adapter may be comprised of a plastic material. In embodiments, a cross piece may be disposed between the first end and the second end. In embodiments of the concept, such an adapter 10 may be disposed (e.g., pushed or inserted) into or onto a dip tube, and the adapter 10 may be held or generally retained in place/position by a feature associated with the adapter. With embodiments, a conical formation on the adapter may also form a seal between it and a dip tube, such as around the edges of the conical formation. In embodiments, wherein the adapter 10 may have an overall width W (see, e.g., FIG. 5) that is less than about one-half of an overall length L of the adapter (see, e.g., FIG. 3). By way of example and without limitation, an embodiment of an adapter 10 may have an overall length L, which may be about 27 mm, and an overall width W, which may be about 12 mm.

Figure 2:
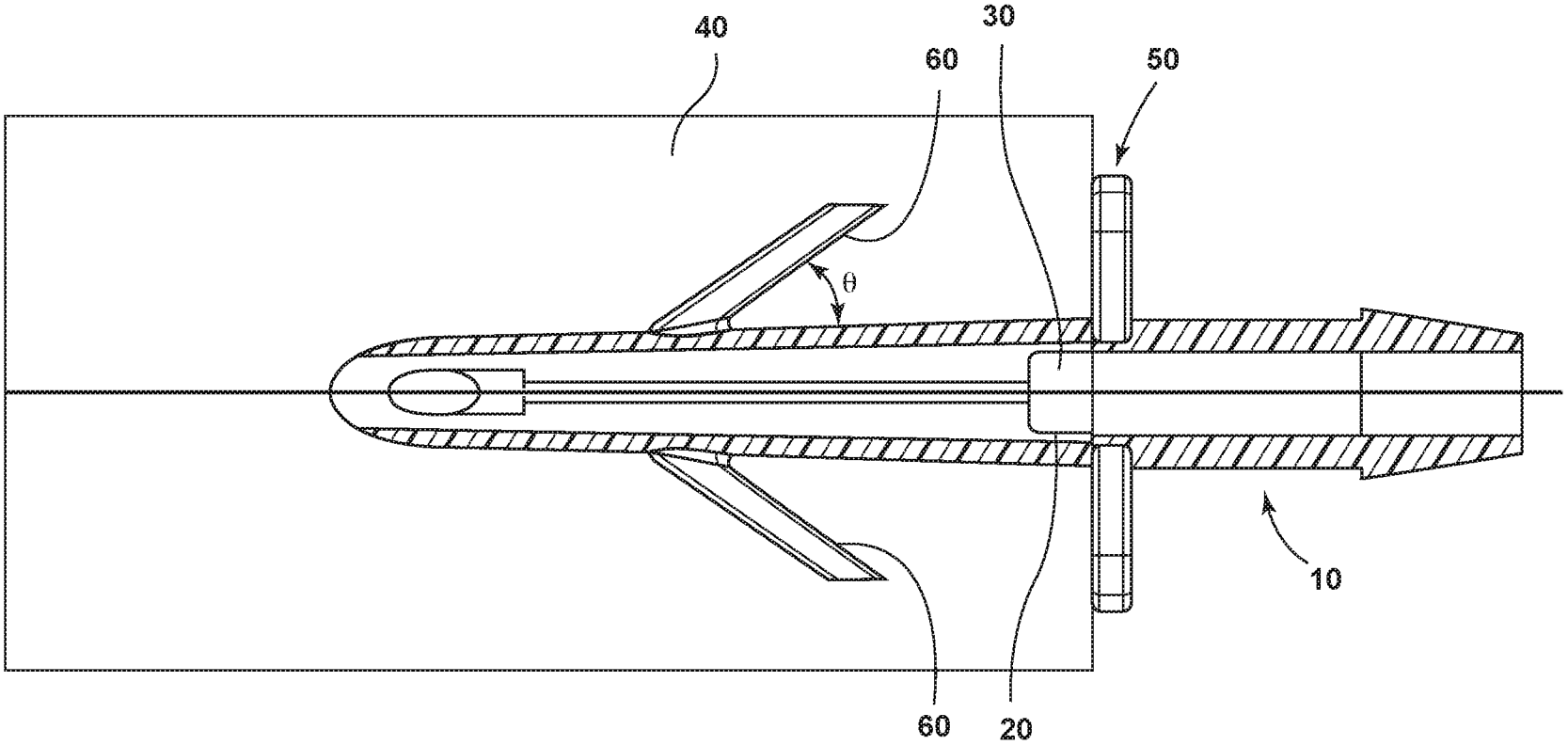
FIG. 2 is a cross-sectional side view generally illustrating an embodiment of an adapter and foam portion/component according to aspects and/or teachings of the present disclosure.

As generally illustrated in FIG. 2, a portion of adapter 10 may extend into another component, including a foam component, or foam 40, which may be comprised of foam. With embodiments, an adapter may be used to, at least in part, take the place of a dip tube. That is, with some embodiments, a portion of a dip tube may extend into an adapter, which in turn may extend at least partially into a foam component. Moreover, the adapter may include an aperture or hole—which may essentially take the place of, or perform a similar function, as a hole associated with a dip tube. As such, fluid in the container may be in (or be absorbed into) the foam component covering the aperture or hole in the adapter, and such fluid may be drawn into the aperture or hole. When the fluid level is low enough, the foam component will no longer be able to draw up the fluid high enough to cover the aperture or hole, and gas will be drawn through the aperture or hole in the adapter. The fluid may, for example, comprise liquor. However, the fluid may also comprise some of the gas in the container if the gas is soluble. For example, carbon dioxide (CO2) can exist both in a fluid and above it.

The use of an adapter can provide a number of advantages. Among other things, an internal aperture or hole in the adapter may increase in an area where an inlet hole for air is disposed or situated. For example, as generally illustrated in FIG. 2, a portion of the adapter 10 may include an expanded chamber 30. Such a configuration can create or provide a larger chamber, which can create or be associated with a drop in pressure of an incoming fluid. Such a pressure drop can permit gas to be pulled or sucked into a small hole and it can mix with fluid from the container. As such, the hole 20 (which may comprise a tangential airhole, such as generally shown in FIG. 2) may become or be used as a venturi hole. Moreover, by varying the size of the inlet hole to the adapter and the venturi hole, the ratio of air or gas to fluid can be varied. In effect, with embodiments, the higher the ratio between the inlet and venturi hole, the lower the ratio of gas to incoming fluid, and vice versa.

While the venture hole is illustrated as being substantially tangential to the chamber. However, the concept is not limited to such a configuration, and the hole may also work with gas entering at other than a tangent and/or at different positions/locations relative to the chamber. By way of example and without limitation, the hole 20 may be sized to have a diameter from about 0.1 mm to about 0.6 mm. In embodiments, the hole 20 may have, for example and without limitation, as diameter of about 0.25 mm or 0.40 mm, and may depend on flow. With some embodiments, the larger the nozzle, the smaller the associated hole. In embodiments, the inclusion of a venturi arrangement may also permit or cause the gas-to-fluid ration to be reduced as the container/can pressure reduces. Such an effect can be useful, for example, if a user has somehow wasted gas. That is, if a user has somehow wasted gas, then the device cannot afford to use as high a ratio as it would if no gas had been wasted (as the final gas pressure may be too low).

In embodiments, a foam 40 may hold a significant volume of a fluid. For instance, in an embodiment in which the fluid is alcohol or liquor, it can be desirable to position the venturi hole near the top portion of the foam—for example and without limitation, within about 1.0 to about 3.0 mm from the top of the foam. However, the present concept is not restricted to such a specific placement.

For some embodiments, to achieve the required hole position, a cross piece 50 may be included with the adapter. The cross piece 50 may be configured so that a portion of the cross piece 50 will contact a top portion of the foam 40 and help to position the venturi hole 20 relative to the cross piece 50 (such as in the tooling). With such configurations, the foam 40 can simply be disposed or put over the adapter 10, so the foam 40 may contact or touch the cross piece 50 (see, e.g., FIG. 2).

Figure 3:
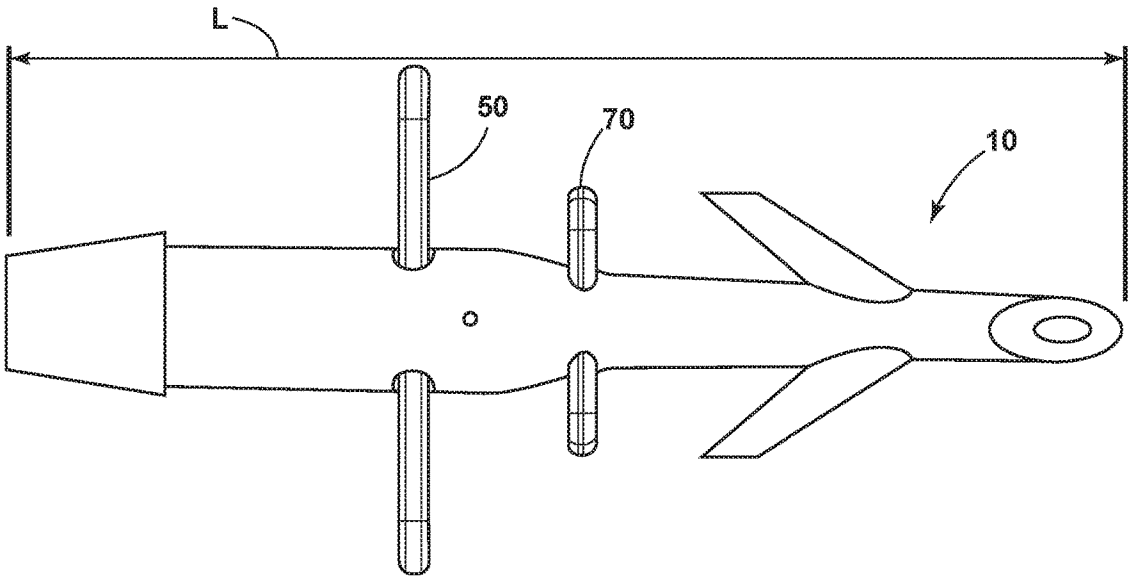
FIG. 3 is a side view generally illustrating an embodiment of an adapter according to aspects and/or teachings of the present disclosure.
Figure 4:
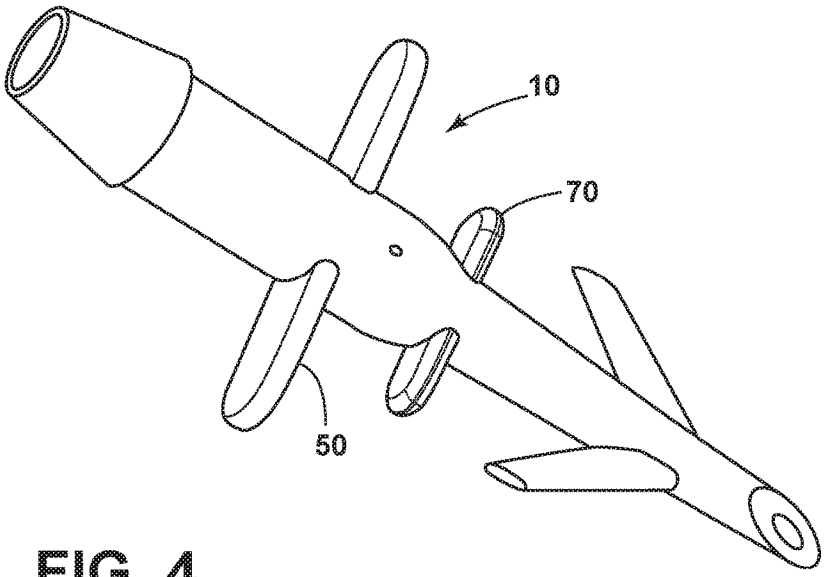
FIG. 4 is a perspective view of an embodiment of an adapter such as generally illustrated in FIG. 3.

In embodiments, an adapter may include additions features that, among other things, can help retain the foam 40 in a desired position with respect to the adapter 10. In an embodiment, such as generally illustrated in FIGS. 1 and 2, the adapter 10 may include one or more barbs 60 (e.g., two barbs positioned approximately 180 degrees from each other about the adapter are illustrated in FIG. 2). In embodiments, one or more barbs may be comprised of plastic. A barb 60 may extend radially from the surface of the adapter in the direction of the cross piece 50 at an acute angle Ø. Also, as may be desired for some applications, the one or more barbs 60 may be constructed and configured to be resiliently deformable. Alternatively, or in addition to the inclusion of one or more barbs, an adapter may include a second/smaller cross piece 70 (see, e.g., FIGS. 3 and 4). By way of example and without limitation, FIG. 5 generally illustrates a top view of an embodiment of an adapter such as generally illustrated in FIGS. 3 and 4.

In embodiments, a small slit may be provided or made in the foam 40, and the slit may extend just downstream of the barbs 60 when in position and the adapter 10 is pushed into the slit and beyond it until the foam 40 meets or contacts the cross piece 50. The one or more barbs 60 are preferably pressed inwardly (radial direction) prior to the insertion, so the barbs 60 can extend outwardly once in position and can help hold the foam 40 in position with respect to the adapter 10. The foam can then, if desired, be rotated (e.g., through 90 degrees) so that a barb 70 pushes or forces its way inside the foam 40 and can then even more firmly secure the foam 40 to the adapter 10. With embodiments, the foam may be relatively soft, so portions of an adapter may be able to move inside the foam either by cutting, displacing, or deforming the foam. Further, when a slit is included in the foam, the slit may tend to be resilient and close around portions of an adapter, which can serve as a seal with respect to portions of the adapter. Also, portions of the adapter that are intended to be disposed within a foam may have shaped ends or portions that can cut or otherwise move through the foam when inserted or moved therein.

In embodiments including a second/smaller cross piece 70, the second/smaller cross piece 70 may also push or force its way into the foam 40 (e.g., when it is rotated therein) and may create a further anchor structure/point. It is noted that such secondary connection rotation is not required. Moreover, as those of skill in the art will readily appreciate, the concept and device is not limited to a specific number of cross pieces and/or barbs.

More than one gas inlet hole can be included with an adapter and under the foam. However, with some embodiments it has been found that one is sufficient and, for some applications, may even be preferable. Varying the position of the holes or holes, and the start of the large chamber relative to the upstream end of the adapter, can vary the amount of fluid left in the container/can when gas enters through the venturi hole.

In embodiments, a foam 40 may overlap an end of an adapter 10. Such positioning can permit additional gas to enter when the container/can is around 97% empty, as it can go through the top of the exposed foam. In embodiments the amount of overlap may be varied, and the overlap may vary when extra gas is added—which could, for example, be done anywhere from 95% to 100% empty (with 97%-98% often being desirable, as it means that a high ratio can be used at the very end when it is most needed).

Figure 7:
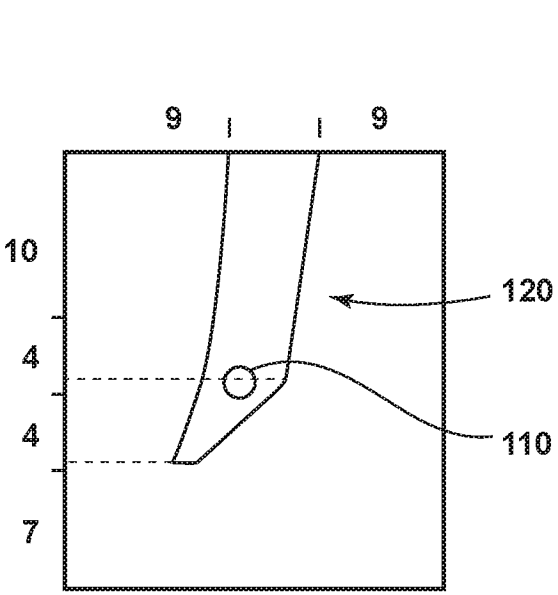
FIG. 7 is a side view representation of a portion of a pin.
Figure 6:
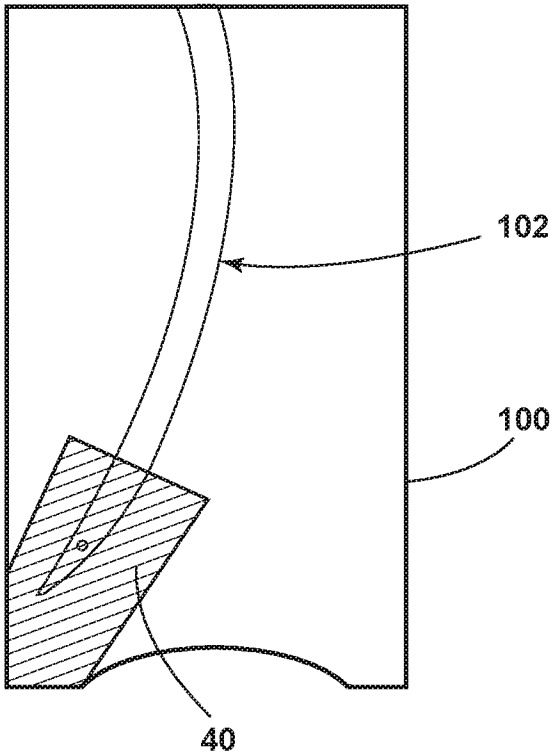
FIG. 6 is a side view representation of a dip tube and foam component extending to a bottom of a container.

FIG. 6 generally illustrates a side view representation of a dip tube and foam (or foam component) 40 extending to a bottom of a container 100. By way of example and without limitation, as generally illustrated, the dip tube may provide a natural bend—such as a bend at or about position 102—and the foam 40 may just touch or contact a base of a recess in a container 100, such as in a sidewall of the container. As generally, illustrated in FIG. 7, is a side view representation of a portion (pin portion) of an adapter (e.g., portion 110). As generally illustrated, the pin portion 110 may include a leak hole 120. Without limitation, in embodiments the leak hole 120 may be similar in size (or slightly smaller than) hole 20.

Various embodiments are described herein for various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details. In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments.

Reference throughout the specification to "various embodiments," "with embodiments," "in embodiments," or "an embodiment," or the like, means that a particular feature, structure, or characteristic described in connection with the embodiment is included in at least one embodiment. Thus, appearances of the phrases "in various embodiments," "with embodiments," "in embodiments," or "an embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment/example may be combined, in whole or in part, with the features, structures, functions, and/or characteristics of one or more other embodiments/examples without limitation given that such combination is not illogical or non-functional. Moreover, many modifications may be made to adapt a particular situation or material to the teachings of the present disclosure without departing from the scope thereof.

It should be understood that references to a single element are not necessarily so limited and may include one or more of such element. Any directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of embodiments.

Joinder references (e.g., attached, coupled, connected, and the like) are to be construed broadly and may include intermediate members between a connection of elements and relative movement between elements. As such, joinder references do not necessarily imply that two elements are directly connected/coupled and in fixed relation to each other. The use of "e.g." in the specification is to be construed broadly and is used to provide non-limiting examples of embodiments of the disclosure, and the disclosure is not limited to such examples. Uses of "and" and "or" are to be construed broadly (e.g., to be treated as "and/or"). For example and without limitation, uses of "and" do not necessarily require all elements or features listed, and uses of "or" are intended to be inclusive unless such a construction would be illogical.

While examples of dimensions of certain components may be described herein, such dimensions are provided as non-limiting examples and the components may have other dimensions.

While processes, systems, and methods may be described herein in connection with one or more steps in a particular sequence, it should be understood that such methods may be practiced with the steps in a different order, with certain steps performed simultaneously, with additional steps, and/or with certain described steps omitted.

It is intended that all matter contained in the above description or shown in the accompanying drawings shall be interpreted as illustrative only and not limiting. Changes in detail or structure may be made without departing from the present disclosure.

What is claimed is:

1. An adapter for a dispenser, the adapter comprising:
- a longitudinal body including:
  - a first end configured for connection with a dip tube; and
  - a second end configured for connection with a foam component; and
- a foam component disposed about at least a portion of the second end of the longitudinal body;
- wherein the second end of the longitudinal body is substantially encased within the foam component.

2. The adapter of claim 1, wherein the adapter is comprised of plastic.

3. The adapter of claim 1, wherein the adapter includes a conical formation at or about an end of the adapter that forms a seal between the adapter and a dip tube.

4. The adapter of claim 1, wherein the adapter has an overall length of about 27 mm.

5. The adapter of claim 1, wherein the adapter has an overall width that is less than about one-half of an overall length of the adapter.

6. The adapter of claim 1, wherein the foam component comprises foam.

7. The adapter of claim 6, wherein the adapter includes a hole that is covered by the foam component and configured to draw a fluid.

8. The adapter of claim 7, wherein, when said fluid can no longer be drawn up through the hole in the adapter covered by the foam component, gas is permitted to be drawn through the hole in the adapter.

9. The adapter of claim 1, including an expanded chamber configured to facilitate a pressure drop associated with a fluid.

10. The adapter of claim 9, wherein the expanded chamber permits gas to be pulled or sucked into a small hole to mix with a fluid in an associated container.

11. The adapter of claim 9, wherein the expanded chamber is disposed between the second end and a cross piece.

12. The adapter of claim 1, wherein the adapter includes an airhole.

13. The adapter of claim 12, wherein the airhole is provided in an expanded chamber.

14. The adapter of claim 1, including an inlet hole and an air hole, wherein the higher a ratio of a diameter of the inlet hole to a diameter of the air hole, the lower a corresponding ratio of incoming gas to incoming fluid, and vice versa.

15. An adapter for a dispenser, the adapter comprising a longitudinal body including:
- a first end configured for connection with a dip tube;
- a second end configured for connection with a foam component; and a cross piece disposed along the longitudinal body between the first end and the second end;

wherein the cross piece extends radially outward beyond at least a portion of said foam component.

16. The adapter of claim 15, including a foam component disposed about at least a portion of the second end, wherein the cross piece contacts or touches the foam component.

17. The adapter of claim 15, including a foam component disposed about at least a portion of the second end, the adapter including one or more barbs that project radially outward into the foam component.

18. The adapter of claim 17, wherein the one or more barbs extend radially outwardly at an acute angle.

19. The adapter of claim 17, wherein the cross piece includes two barbs positioned approximately 180 degrees from each other about the adapter.

20. The adapter of claim 17, wherein the foam component includes a slit.

* * * * *